United States Patent [19]

Kannegiesser et al.

[11] 4,308,737

[45] Jan. 5, 1982

[54] APPARATUS FOR PRODUCING A BEAD ON THE PERIPHERY OF A HOLLOW CYLINDER

[75] Inventors: Reinhard Kannegiesser, Birenbach; Rainer Güthle, Ebersbach-Weiler; Kurt Finsterwalder, Göppingen, all of Fed. Rep. of Germany

[73] Assignee: L. Schuler GmbH, Göppingen, Fed. Rep. of Germany

[21] Appl. No.: 90,614

[22] Filed: Nov. 2, 1979

[30] Foreign Application Priority Data

Nov. 3, 1978 [DE] Fed. Rep. of Germany ..... 2847736

[51] Int. Cl.[3] ..... B21D 19/06; B21D 17/04

[52] U.S. Cl. ..... 72/91; 72/105; 113/73

[58] Field of Search ..... 72/91, 92, 94, 105, 72/106, 350, 351, 120–125; 113/120 AA, 120 M, 120 W, 116 A

[56] References Cited

U.S. PATENT DOCUMENTS

| | | | |
|---|---|---|---|
| 1,705,843 | 3/1929 | Walter | 113/120 W UX |
| 1,912,258 | 5/1933 | Coyle | 72/121 |
| 2,170,946 | 8/1939 | Greif | 113/120 M UX |
| 2,348,085 | 5/1944 | Merolle | 72/91 |
| 2,678,467 | 5/1954 | McCain | 72/91 X |
| 3,182,482 | 5/1965 | Moller | 72/350 |
| 3,315,626 | 4/1967 | Bofinger et al. | 113/120 W X |
| 3,765,351 | 10/1973 | Kubacki et al. | 113/120 AA |
| 4,070,888 | 1/1978 | Gombas | 113/120 AA X |
| 4,176,536 | 12/1979 | Panknin | 72/91 |
| 4,207,761 | 6/1980 | Niemi | 113/120 AA X |

FOREIGN PATENT DOCUMENTS

| | | | |
|---|---|---|---|
| 54545 | 10/1974 | Australia | 113/122 |

*Primary Examiner*—Lowell A. Larson
*Attorney, Agent, or Firm*—Craig and Antonelli

[57] ABSTRACT

Beading apparatus is provided for producing a bead on the periphery of a hollow cylinder, such as a cam body. A rotatable inner ring and a rotatable outer ring co-act to deform a portion of the hollow cylinder therebetween to form a bead. To accommodate a firm backing of the exterior of the hollow cylinder during beading operations, while also permitting the removal of a beaded hollow cylinder from the apparatus, a depressor is provided which is formed as a basket with springing tongues separated by axially extending slots. A tapered cylinder liner is provided for forcing the springing tongues to a smaller diameter configuration to provide backing for the hollow cylinder during beading operations, with the springing tongues being movable to a larger diameter to permit removal of the hollow cylinder subsequent to beading operations.

8 Claims, 3 Drawing Figures

23
2
18
5
6
22
21
19
20
3
17
16
8
4
10
7
12
11
9
13
14
15
1

24
2
18
25
22
21
5
6
19
20
3
17
III
III
4
16
8
10
7
12
11
9
13
15
14
1

APPARATUS FOR PRODUCING A BEAD ON THE PERIPHERY OF A HOLLOW CYLINDER

BACKGROUND AND SUMMARY OF THE INVENTION

The invention relates to apparatus for producing a bead on the periphery of a hollow cylinder. In this respect, the production of a bead must be understood in its general sense comprising also the production of a constriction (with or without a flange) or of a flange at the end of a hollow cylinder. Commonly assigned U.S. application Ser. No. 925,296, filed July 17, 1978, now U.S. Pat. No. 4,176,536 titled "Device For Producing A Bead On The Circumference Of A Hollow Cylinder", relates to this type of apparatus; the contents of said application being incorporated herein by reference thereto or an aid to understanding the present invention.

In the case of previously contemplated apparatus of this type (DOS No. 28 05 321), the inner tool is constructed functionally in one piece, while the outer tool consists of an outer ring and a depressor which is axially adjacent and radially adjustable in respect of the outer ring. This means that in the case of the known devices, during progressive production of the bead, the area of the hollow cylinder in which the bead is to be made is unsupported and is pressed inwardly by the tool while the area of the hollow cylinder adjacent the area in which the bead is to be made remains without adequate support from the outer tool and can in consequence become outwardly buckled. These two circumstances can individually, but in particular jointly, lead to undesired deformations of the hollow cylinder, particularly (wrinkling) creasing and buckling (bulging). Creasing in the area of the bead occurs for example if there is not adequate support from the inner tool, on the basis of impurities in the surface of the hollow cylinder, while outward buckling is caused by inadequate supporting from the depressor which, by virtue of its diameter being invariable and enlarged in relation to the hollow cylinder, only partially engages the hollow cylinder periphery.

An object of the invention is to eliminate the risk of such undesired deformation occurring and thereby achieve an improvement in quality of beaded hollow cylinders.

In particularly preferred embodiments, the above-noted problems are avoided by providing a depressor formed as a basket with springing tongues separated by axial slots and acted on by a tapered cylinder, so that the effective diameter of the depressor can be varied to optimize backing of the hollow cylinder during beading operation, while also permitting return of the basket to an enlarged diameter to accommodate placement and removal of the hollow cylinders being beaded. The advantageous effect of this solution is based thereby on the fact that, during the progressive production of the bead, the inner ring supports from inside the area on which the bead is to be provided, while the depressor with the cylinder liner and the basket with the spring-action tongues supports the entire hollow cylinder from outside, particularly also in the region adjacent to that in which the bead is to be made and stabilizes its circular shape. Hereby, the necessary radial adjustments of the depressor in relation to the outer ring and of the inner ring in relation to the carrier mandrel, necessary according to this purpose are derived directly from the apparatus drive through corresponding positioning means.

With regard to the construction of the cylinder liner and of the basket with spring tongues separated by axial slots, use is made of the per se known principle of screw clamp guides (DAS No. 23 35 745).

A relatively simple construction of the apparatus arises if the said radial adjustments are only indirectly derived from the drive of the apparatus. According to particularly preferred embodiments, this can be achieved if radially acting springs urge the inner ring and the carrier mandrel on the one hand and the outer ring and the depressor on the other into mutually coaxial positions. If the radial spacing of the outer ring from the axis of the carrier mandrel diminishes during progressive production of the bead, then under pressure of the outer ring which acts radially from outside, the inner ring is moved radially inwardly in relation to the carrier mandrel while under the radially acting pressure of the carrier mandrel from within, the depressor moves radially outwardly in relation to the outer ring.

In the case of a development of the apparatus according to the invention in which the outer tool is radially inwardly adjustable in relation to the inner tool against the force of a radially outwardly acting spring, as is known per se (German Pat. No. 750 476), and in which, therefore, from the drive of the apparatus, only a radially inwardly directed movement of the outer tool in relation to the inner tool is directly derived, another embodiment acquires a particularly simple and compact construction. This embodiment is characterized in that the springs acting on the outer tool, the cylinder liner and the inner ring are axially disposed and in that their forces are diverted in a radial direction via pairings of bevel ring faces.

The described radial adjustments can also be brought about against the forces of correspondingly disposed cylinder-piston units, a particularly simple and compact construction being achieved if the cylinder-piston units are axially disposed and if the forces are diverted in a radial direction through pairs of bevel rings enclosing the shaft of the carrier mandrel.

The apparatus according to the invention, both in per se known single arrangement (German Pat. No. 750 476) as well as in per se known multiple arrangement (DOS No. 22 18 396), is available for use with a plurality of inner and outer tools disposed in stellate fashion on a rotatingly drivable tool carrier. In the case of a multiple arrangement, it is expedient according to the invention for the controlled radial adjustability of the outer tools in relation to the inner tools to be by means of a control cam which engages partially around the tool carrier, and to be derived from the drive for the rotatable mandrels.

DETAILED DESCRIPTION OF THE PREFERRED EMBODIMENTS

Figure 1:
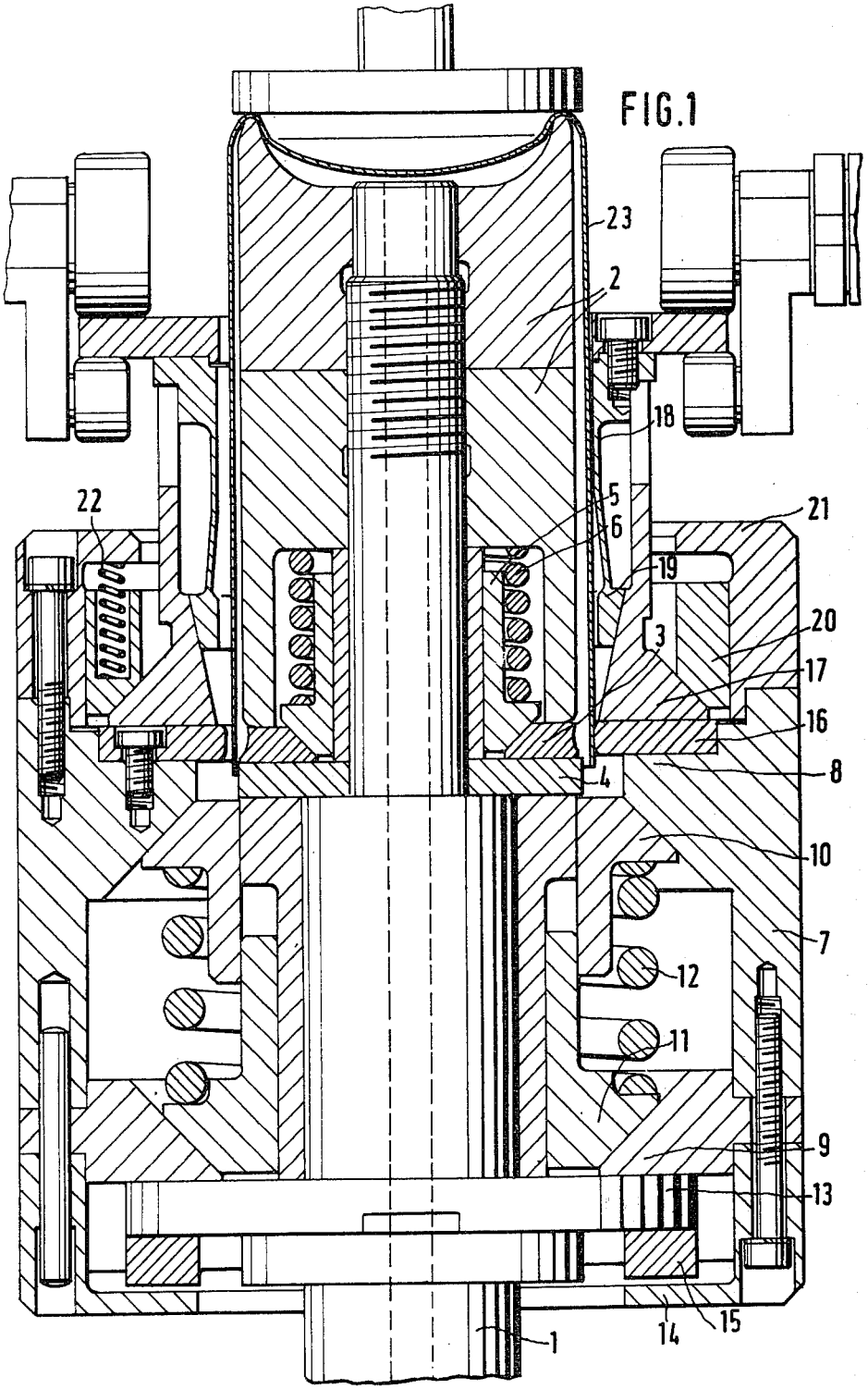
FIG. 1 is a schematic partial cross-sectional view of a preferred embodiment of the present invention, shown in a position prior to commencement of production of a bead.

In a (not shown in the drawings) tool carrier there is rotatably mounted a tool spindle 1 on which (likewise not shown in the drawings) a rotary drive engages. Fixed on the tool spindle 1 is a carrier mandrel 2 which rotates with the tool spindle 1. Axially adjacent the carrier mandrel 2 there is an inner ring 3 radially adjustable mounted on the tool spindle 1. Ring 3 rotates with the tool spindle 1. The inner ring 3 is axially guided between a collar 4 on the tool spindle 1 and the carrier mandrel 2. The inner ring 3 has an inner bevel ring face which co-operates with an outer bevel ring face provided on a sleeve 5 which is axially displaceable on and likewise rotatable with the tool spindle 1. The sleeve 5 is subject to the action of an axially disposed spring 6 braced at the other end on the carrier mandrel 2 and which urges the sleeve 5 in the direction of the collar 4 and thus the inner ring 3 into a position coaxial with the carrier mandrel 2.

Also axially immovable and radially adjustably mounted on the tool spindle 1 is a circular casing 7 enclosing a portion of the spindle. The casing 7 has on two inner annular discs 8, 9 in each case an inner bevel ring face, the two bevel ring faces having oppositely directed slopes. Co-operating with the inner bevel ring faces on the inner annular discs 8, 9 co-operate outer bevel ring faces with oppositely disposed slopes which are provided on two clamping sleeves 10, 11 which are displaceable on the tool spindle 1 and movable axially in respect of each other. The two clamping sleeves 10, 11 are subject to the action of a clamping spring 12 disposed axially between the two clamping sleeves 10, 11 and which seeks to force the two clamping sleeves axially apart from each other so urging the casing 7 into a position coaxial of the tool spindle 1. The two clamping sleeves 10, 11 and the clamping spring 12 rotate jointly with the tool spindle 1.

Within the casing 7, the tool spindle 1 is provided with a driving plate 13, the rear annular disc 9 which is remote from the carrier mandrel 2 bearing in guiding fashion on that face of the drive disc 13 which is towards the carrier mandrel 2. Between the rear face of the drive disc 13 which is away from the carrier mandrel 2 and a rear end wall 14 of the casing 7 there is a loosely mounted drive ring 15 by which the rotary drive is transmitted from the tool spindle 1 to the casing 7. To this end, the driving ring 15 has on its side which is towards the carrier mandrel 2 two groove blocks which engage into the groove on the rear side of the drive disc 13 and on its side remote from the carrier mandrel 2 two groove blocks which engage in a groove on the rear end wall 14 of the casing 7, whereby the two grooves—viewed in an axial direction—extend at a right-angle to each other. The casing 7 is guided on the tool spindle 1 on the one hand by the mounting of the drive disc 13 between the rear annular plate 9 and the drive ring 15 which is braced against the rear end wall 14 of the casing 7, and at the other by the two pairings of bevel ring faces between the two annular discs 8, 9 and the two clamping sleeves 10, 11. On the side of the front annular disc 8 which is towards the carrier mandrel 2, an outer ring 16 is fixed on the casing 7. Axially adjacent to the outer ring 16 is a depressor consisting of a cylinder liner 17 and a basket 18 which is displaceably mounted in the liner 17. The basket has axial slots separated by tongues 19 which are guided on the conically tapering inner shell of the cylinder liner 17. The cylinder liner 17 has an outer bevel ring face which co-operates with an inner bevel ring face on a bevel ring 20. The bevel ring 20 is axially displaceable in the casing 7 and is subject to the action of axially disposed thrust springs 22 braced at the other end of a front end wall 21 of the casing 7, which urge the bevel ring 20 in the direction of the outer ring 16 and thus urge the cylinder liner 17 and the basket 18 into a position coaxial with the outer ring 16. Together with the casing 7 rotate the outer ring 16, the bevel ring 20, the thrust springs 22 and the depressor consisting of the cylinder liner 17, the basket 18 and the tongues 19.

The mode of operation of the apparatus described resides in that in the position before commencement of production of a bead (FIG. 1), an unbeaded hollow cylinder 23 is pushed axially over the carrier mandrel 2, the inner ring 3 and a part of the collar 4. The depressor is closed, i.e., the basket 18 is moved inside the cylinder liner 17 and towards the outer ring 16. The tongues 19 slide thereby on the conically tapering inner shell of the cylinder liner 17 into a second extreme position in which the hollow cylinder 23 is closely enclosed and stabilized in its circular shape.

Figure 2:
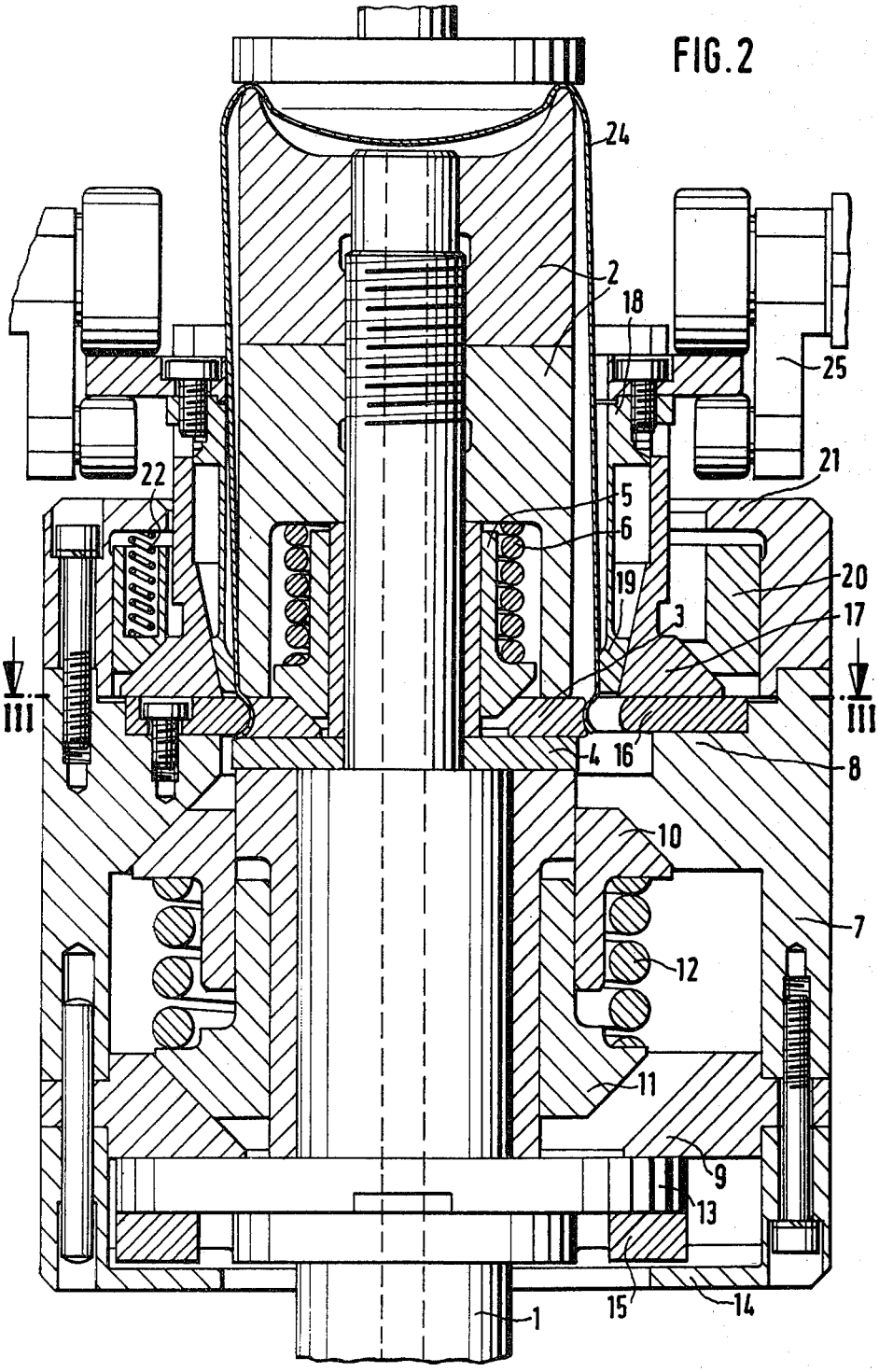
FIG. 2 is a view simlar to FIG. 1, but showing the apparatus in a position after completed production of the bead.
Figure 3:
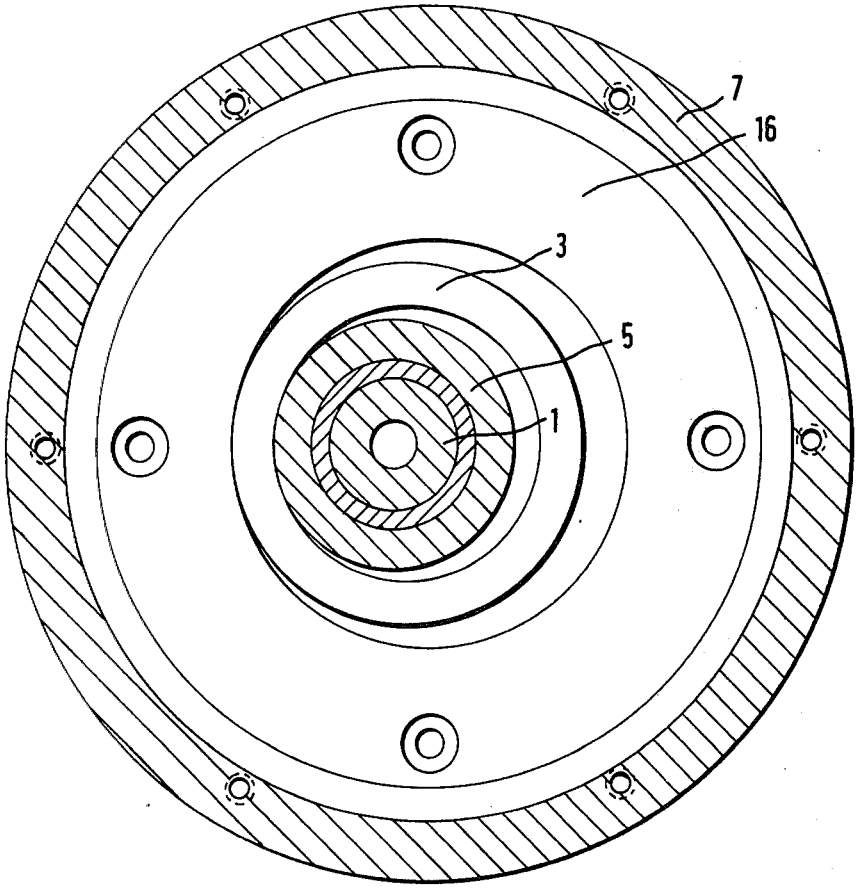
FIG. 3 is a sectional view taken on the line III—III in FIG. 2.

The entire apparatus then rotates jointly with the unbeaded hollow body 23 under the action of the rotary drive acting on the tool spindle 1. Production of the bead commences in that for example via a rolling-type bearing not shown in the drawing, which encloses the outside of the casing 7, a progressive radial movement of the casing 7 in respect of the tool spindle 1 is initiated. In consequence, on the side of the tool spindle 1 on which the casing 7 is brought close to the tool spindle 1, the depressor 17, 18, 19 comes to bear over the unbeaded hollow cylinder 23 on the carrier mandrel 2 and the outer ring 16 comes to bear on the inner ring 3 over that area of the unbeaded hollow cylinder 23 in which the bead is to be made. With progressive radial movement of the casing 7, and in the direction of movement, the inner ring 3 is adjusted radially in respect of the carrier mandrel 2 and in the opposite direction the depressor 17, 18, 19 is displaced radially in relation to the outer ring 16 until radial movement is concluded, whereupon production of the bead is completed and the beaded hollow cylinder 24 is produced (FIG. 2). While the bead is being produced, the portion of the hollow body 23 which was at the start pushed over the collar 4 is drawn into the bead. The basket 18 is now moved back to its other extreme position so that the tongues 19 have an inside diameter which is enlarged in relation to the outside diameter of the hollow body 24 (FIG. 2) and the beaded hollow body 24 can be removed without problem. Movement of the basket 18 between the two extreme positions is effected by a cam plate transmission 25 which is coupled in a suitable fashion to the drive of the apparatus.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

What is claimed is:

1. Beading apparatus for producing a bead on the periphery of a hollow cylinder, such as a can body, comprising:

an internal tool having a maximum cross-sectional dimension smaller than the inner diameter of the hollow cylinder after it has been beaded, an external tool in the form of a ring having an inner cross-sectional dimension greater than the outer diameter of the unbeaded hollow cylinder, means for rotatably driving at least one of said internal and external tools with controlled radial adjustment of said tools with respect to one another so that the hollow cylinder can be rolled and deformed between the outer periphery of the internal tool and the inner periphery of the external tool to form a bead thereon, and a depressor axially adjacent one of said tools for supporting the hollow cylinder at a location axially adjacent the region where the bead is being formed, wherein the depressor is formed as a basket with springing tongues separated by axial slots, such spring tongues being movably engagable with a conically tapering surface of a cylinder liner to effect a change in the effective diameter of the basket so that such springing tongues can adjustably closely engage against the periphery of the hollow cylinder during beading operations while being springably movable to a rest position permitting movement of the hollow cylinder to and from the beading apparatus.

2. Apparatus according to claim 1, wherein the depressor is located axially adjacent the external tool to engage the outside surface of the hollow cylinder during beading operations.

3. Apparatus according to claim 2, wherein the basket is adjustable between first and second extreme positions, and wherein spring tongues are dimensioned to fit closely against the periphery of the hollow cylinder when said basket is in said first extreme position and to have an inside diameter greater than the outside diameter of the hollow cylinder when in a second extreme position.

4. Apparatus according to claim 3, wherein each of said internal and external tools are circular and rotatable.

5. Apparatus according to claim 3, wherein the external tool includes an outer ring directly engageable with the hollow cylinder to form said bead, and wherein the cylinder liner is radially outwardly adjustable in relation to the outer ring against the force of a radially inwardly acting spring.

6. Apparatus according to claim 3, wherein the inner tool includes an inner ring directly engageable with the hollow cylinder to form said bead, said inner ring being supported at a carrying mandrel, and wherein the inner ring is radially inwardly adjustable against the force of a radially outwardly acting spring in relation to the carrying mandrel.

7. Apparatus according to claim 5 or 6, in which the external tool is radially inwardly adjustable in relation to the internal tool, against the force of a radially outwardly acting spring, characterized in that the springs acting on the outer tool, the cylinder liner and the inner ring are axially disposed in that their forces are diverted in a radial direction via pairings of bevel ring faces.

8. Apparatus according to claim 1, wherein in each case a cylinder-piston unit which is subject to the action of a pressurized medium is provided, against the forces of which on the one hand the external tool is radially inwardly adjustable in relation to the internal tool, while on the other hand the depressor is radially outwardly adjustable in relation to the external tool and finally the inner ring is radially inwardly adjustable in relation to a carrying mandrel.

* * * * *